US011476043B2

(12) United States Patent
Syed Mohammed et al.

(10) Patent No.: US 11,476,043 B2
(45) Date of Patent: Oct. 18, 2022

(54) INDUCTIVE DEVICES AND METHODS OF FORMING INDUCTIVE DEVICES

(71) Applicant: GLOBALFOUNDRIES Singapore Pte. Ltd., Singapore (SG)

(72) Inventors: Zishan Ali Syed Mohammed, Singapore (SG); Lulu Peng, Singapore (SG); Lawrence Selvaraj Susai, Singapore (SG); Chor Shu Cheng, Singapore (SG)

(73) Assignee: GLOBALFOUNDRIES Singapore Pte. Ltd., Singapore (SG)

( * ) Notice: Subject to any disclaimer, the term of this patent is extended or adjusted under 35 U.S.C. 154(b) by 500 days.

(21) Appl. No.: 16/729,545

(22) Filed: Dec. 30, 2019

(65) Prior Publication Data

US 2021/0202165 A1 Jul. 1, 2021

(51) Int. Cl.

| | |
|---|---|
| ***H01F 27/36*** | (2006.01) |
| ***H01F 27/28*** | (2006.01) |
| ***H01F 27/32*** | (2006.01) |
| ***H01F 41/02*** | (2006.01) |
| ***H01F 41/12*** | (2006.01) |

(Continued)

(52) U.S. Cl.

CPC ..... *H01F 27/36* (2013.01); *H01F 27/2804* (2013.01); *H01F 27/32* (2013.01); *H01F 41/0206* (2013.01); *H01F 41/041* (2013.01); *H01F 41/12* (2013.01); *H01F 2027/2809* (2013.01); *H01F 2027/348* (2013.01)

(58) Field of Classification Search

CPC ..... H01F 27/36; H01F 27/2804; H01F 27/32; H01F 41/0206; H01F 41/041; H01F 41/12; H01F 2027/2809

USPC ..... 336/200

See application file for complete search history.

(56) References Cited

U.S. PATENT DOCUMENTS

| | | | |
|---|---|---|---|
| 7,584,533 | B2 | 9/2009 | Smeys et al. |
| 8,205,324 | B2 | 6/2012 | Smeys et al. |

(Continued)

OTHER PUBLICATIONS

Lee et al., "Fabrication and Analysis of High-Performance Integrated Solenoid Inductor With Magnetic Core", IEEE Transactions on Magnetics, 2008, pp. 4089-4095, vol. 44, No. 11, IEEE.

(Continued)

*Primary Examiner* — Alfonso Perez Borroto

(74) *Attorney, Agent, or Firm* — Viering Jentschura & Partner MBB

(57) ABSTRACT

An inductive device may be provided, including a substrate and an inductive structure arranged over the substrate. The inductive structure may include a bottom metal winding layer; a top metal winding layer arranged further away from the substrate than the bottom metal winding layer; a magnetic core layer arranged between the bottom metal winding layer and the top metal winding layer; a connector arranged to electrically connect the bottom metal winding layer and the top metal winding layer; and a top metal ring element arranged around the top metal winding layer, spaced apart from the top metal winding layer. The inductive device may further include a guard ring element arranged under the top metal ring element and around the magnetic core layer, spaced apart from the magnetic core layer; wherein the guard ring element may include a magnetic material.

20 Claims, 5 Drawing Sheets

(51) Int. Cl.
*H01F 41/04* (2006.01)
*H01F 27/34* (2006.01)

(56) References Cited

U.S. PATENT DOCUMENTS

| | | | | |
|---|---|---|---|---|
| 8,421,188 | B2 | 4/2013 | Uchida et al. | |
| 2009/0256687 | A1* | 10/2009 | French | H01L 28/10 336/200 |
| 2014/0240071 | A1* | 8/2014 | Alderton | H01F 17/0013 336/200 |
| 2018/0097055 | A1* | 4/2018 | Pizzi | H01L 23/645 |
| 2018/0130867 | A1* | 5/2018 | Lambkin | H01L 28/10 |

OTHER PUBLICATIONS

Feeney et al., "A 20 MHz 1.8 W DC-DC Converter with Parallel Microinductors and Improved Light-Load Efficiency", IEEE Transactions on Power Electronics, 2013, 9 pages, IEEE.
Sturcken et al., "Magnetic Thin-Film Inductors for Monolithic Integration with CMOS", 2015 IEEE International Electron Devices Meeting (IEDM), 2015, 4 pages, IEEE.
Wang et al., "High-Q Magnetic Inductors for High Efficiency On-Chip Power Conversion", 2016 IEEE International Electron Devices Meeting (IEDM), 2016, 4 pages, IEEE.
Krishnamurthy et al., "A Digitally Controlled Fully Integrated Voltage Regulator with On-Die Solenoid Inductor with Planar Magnetic Core in 14nm Tri-Gate CMOS", 2017 IEEE International Solid-State Circuits Conference, 2017, 3 pages, IEEE.
Gardner et al., "Integrated On-Chip Inductors with Magnetic Films", 2006 International Electron Devices Meeting, 2006, 4 pages, IEEE.

* cited by examiner

INDUCTIVE DEVICES AND METHODS OF FORMING INDUCTIVE DEVICES

TECHNICAL FIELD

The present disclosure relates generally to inductive devices and methods of forming the inductive devices.

BACKGROUND

Electrical appliances, such as mobile phones and laptop computers, often include inductive devices. One type of inductive device that may be used for electrical appliances is the solenoid magnetic device. A solenoid magnetic device usually includes one or more conductive coils (solenoids) wound around a magnetic core formed of ferromagnetic material such as iron. When a current (which may be an alternating current or a direct current) passes through the solenoids, a magnetic field is induced in the solenoids. This induced magnetic field magnetizes the magnetic core, and the magnetic field of the magnetized magnetic core adds to the magnetic field induced in the solenoids. Accordingly, the inclusion of the magnetic core helps to increase the strength of the magnetic field produced in the solenoid magnetic device, hence increasing the inductance of this device especially at lower operating frequencies.

However, the higher magnetic field strength of the solenoid magnetic device can result in a higher number of stray magnetic field lines. These stray magnetic field lines often extend to adjacent metallic components (e.g. metal lines, devices, circuitry), causing greater magnetic interference to these metallic components and adversely affecting their operations. For example, the stray magnetic field lines can induce eddy currents in the metallic components, which can cause excessive eddy current loss in these components.

SUMMARY

According to various non-limiting embodiments, there is provided an inductive device. The inductive device may include: a substrate; an inductive structure arranged over the substrate, where the inductive structure may include: a bottom metal winding layer, a top metal winding layer arranged further away from the substrate than the bottom metal winding layer, a magnetic core layer arranged between the bottom metal winding layer and the top metal winding layer, a connector arranged to electrically connect the bottom metal winding layer and the top metal winding layer; and a top metal ring element arranged around the top metal winding layer, spaced apart from the top metal winding layer. The inductive device may further include a guard ring element arranged under the top metal ring element and around the magnetic core layer, spaced apart from the magnetic core layer, where the guard ring element may include a magnetic material.

According to various non-limiting embodiments, there is provided a method of forming an inductive device. The method may include: providing a substrate; forming an inductive structure over the substrate, where the inductive structure may include: a bottom metal winding layer, a top metal winding layer arranged further away from the substrate than the bottom metal winding layer, a magnetic core layer arranged between the bottom metal winding layer and the top metal winding layer, a connector arranged to electrically connect the bottom metal winding layer and the top metal winding layer; and a top metal ring element arranged around the top metal winding layer, spaced apart from the top metal winding layer. The method may further include forming a guard ring element of magnetic material around the magnetic core layer, where the guard ring element may be under the top metal ring element and spaced apart from the magnetic core layer.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. Embodiments of the invention will now be illustrated for the sake of example only with reference to the following drawings, in which.

DETAILED DESCRIPTION

Figure 1A:
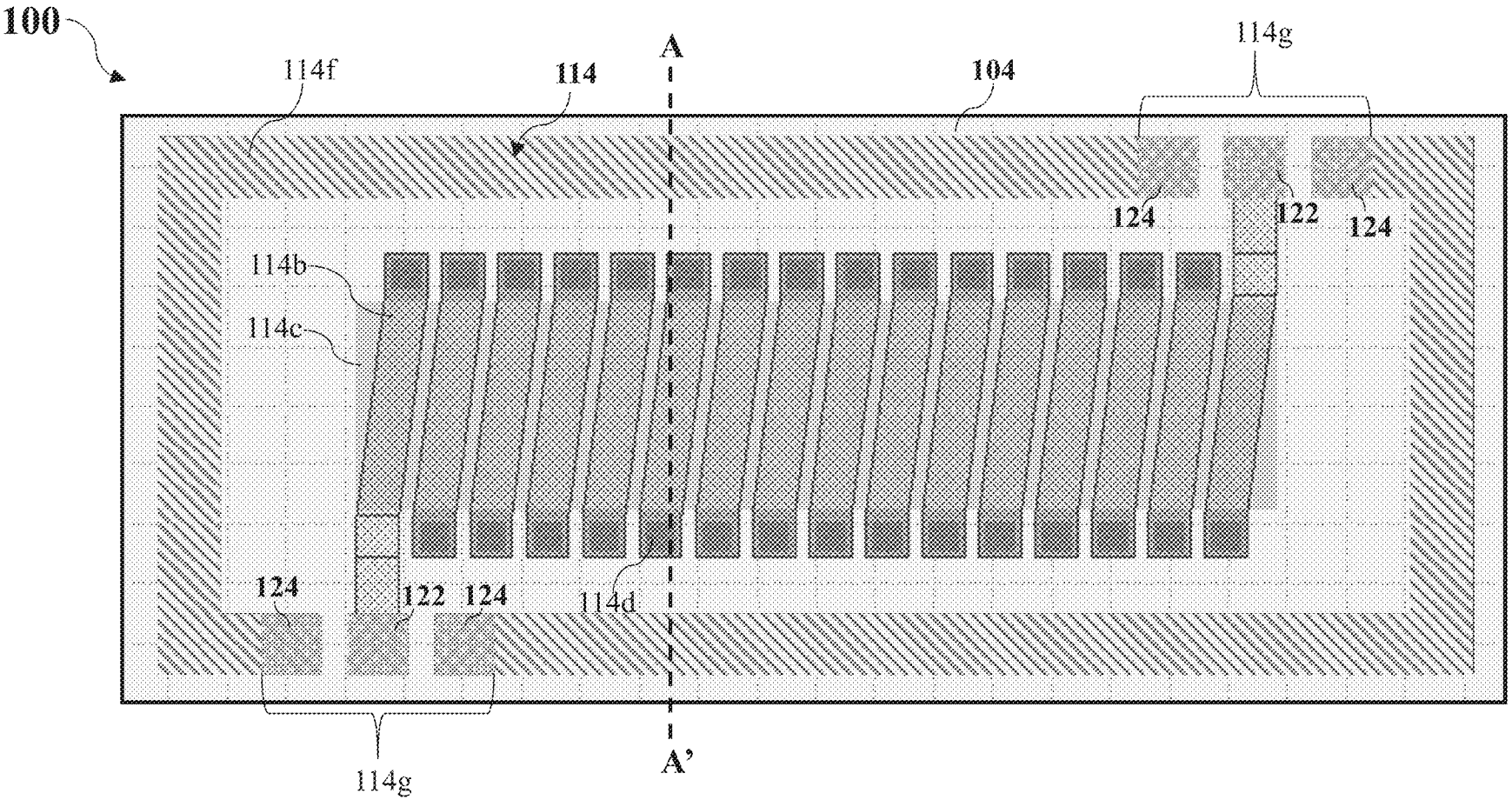
FIG. 1A and FIG. 1B respectively show a simplified top view and a simplified cross-sectional view of an inductive device according to various non-limiting embodiments.

The embodiments generally relate to semiconductor devices. More particularly, some embodiments relate to inductive devices including one or more inductive structures. The inductive devices may include solenoid magnetic devices, such as, but not limited to, on-chip integrated solenoid magnetic devices and on-chip discrete solenoid magnetic devices. The inductive devices may be used for power management, for example, in power system-on-chips, and may be used for various electrical appliances, such as, but not limited to, handheld consumer electronics products.

Aspects of the present invention and certain features, advantages, and details thereof, are explained more fully below with reference to the non-limiting examples illustrated in the accompanying drawings. Descriptions of well-known materials, fabrication tools, processing techniques, etc., are omitted so as not to unnecessarily obscure the invention in detail. It should be understood, however, that the detailed description and the specific examples, while indicating aspects of the invention, are given by way of illustration only, and are not by way of limitation. Various substitutions, modifications, additions, and/or arrangements, within the spirit and/or scope of the underlying inventive concepts will be apparent to those skilled in the art from this disclosure.

Approximating language, as used herein throughout the specification and claims, may be applied to modify any quantitative representation that could permissibly vary without resulting in a change in the basic function to which it is related. Accordingly, a value modified by a term or terms, such as "about," is not limited to the precise value specified. In some instances, the approximating language may correspond to the precision of an instrument for measuring the value.

The terminology used herein is for the purpose of describing particular examples only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include (and any form of include, such as "includes" and "including"), and "contain" (and any form of contain, such as "contains" and "containing") are open-ended linking verbs. As a result, a method or device that "comprises," "has," "includes" or "contains" one or more steps or elements possesses those one or more steps or elements, but is not limited to possessing only those one or more steps or elements. Likewise, a step of a method or an element of a device that "comprises," "has," "includes" or "contains" one or more features possesses those one or more features, but is not limited to possessing only those one or more features. Furthermore, a device or structure that is configured in a certain way is configured in at least that way, but may also be configured in ways that are not listed.

As used herein, the term "connected," when used to refer to two physical elements, means a direct connection between the two physical elements. The term "coupled," however, can mean a direct connection or a connection through one or more intermediary elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable or suitable. For example, in some circumstances, an event or capacity can be expected, while in other circumstances the event or capacity cannot occur—this distinction is captured by the terms "may" and "may be."

Figure 1B:
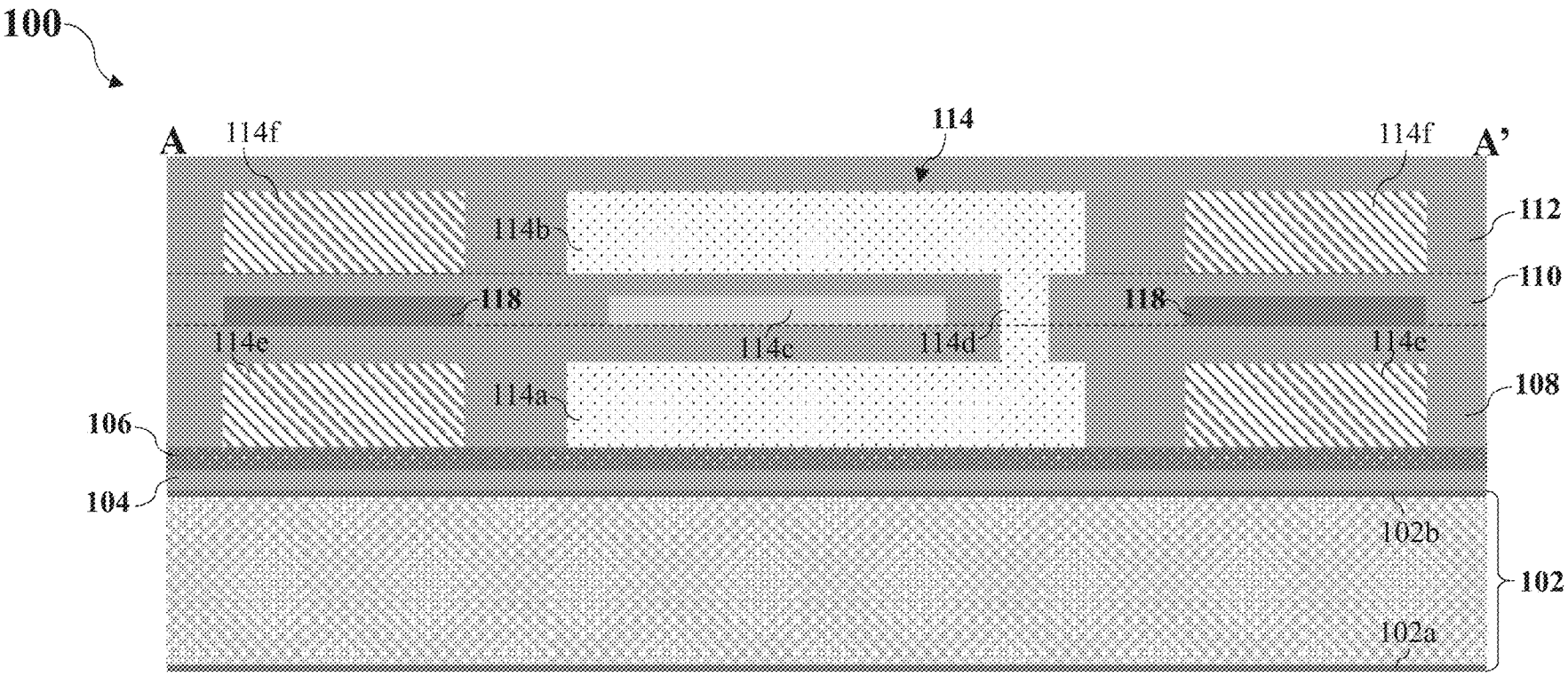

FIG. 1A shows a simplified top view of an inductive device 100 according to various non-limiting embodiments. FIG. 1B shows a cross-sectional view of the inductive device 100 along the line A-A' of FIG. 1A. The inductive device 100 may be an on-chip solenoid magnetic device and may be used for power management. For example, the inductive device 100 may be an inductor or a transformer.

As shown in FIG. 1B, the inductive device 100 may include a substrate 102. The substrate 102 may be a semiconductor substrate, such as a silicon substrate. The substrate 102 may include a first oxide layer 102*a* along a bottom surface and a second oxide layer 102*b* along a top surface. The first and second oxide layers 102*a*, 102*b* may include thermal oxide such as, but not limited to, silicon dioxide.

The inductive device 100 may further include a shielding layer 104 arranged over the substrate 102. The shielding layer 104 may include a magnetic material, and may hence be referred to as a magnetic shielding plane or a magnetic film. For example, the shielding layer 104 may include a soft amorphous magnetic material such as, but not limited to, cobalt-based alloys, nickel-ferrite based alloys, or combinations thereof. The shielding layer 104 may be patterned and/or may include a laminated magnetic material. The shielding layer 104 may be configured to have a substantially small thickness, so as to reduce the costs of forming this layer 104. For example, a thickness of the shielding layer 104 may range from about 100 nm to about 300 nm (and may be about 200 nm in a particular non-limiting embodiment). Further, the shielding layer 104 may be continuous.

Referring to FIG. 1B, the inductive device 100 may also include an insulative layer 106 arranged over the shielding layer 104. The insulative layer 106 may include insulating material. For example, the insulative layer 106 may include dielectric material, such as, but not limited to, tetraethoxysilane (TEOS), silicon nitride (SiN) or combinations thereof. A thickness of the insulative layer 106 may be substantially the same as a thickness of the shielding layer 104, and may also range from about 100 nm to about 300 nm.

The inductive device 100 may further include a first insulating layer 108 arranged over the insulative layer 106, a second insulating layer 110 arranged over the first insulating layer 108 and a third insulating layer 112 arranged over the second insulating layer 110. Each of the first, second and third insulating layers 108, 110, 112 may include an insulating material. For example, each insulating layer 108, 110, 112 may include a dielectric material, such as, but not limited to, conventional polyimides, polybenzoxazole (PBO), benzocyclobutene (BCB) or combinations thereof. The first, second and third insulating layers 108, 110, 112 may include a same insulating material. However, the first, second and third insulating layers 108, 110, 112 may include different insulating materials. For simplicity, the insulative layer 106 and the insulating layers 108, 110, 112 are not shown in FIG. 1A.

As shown in FIGS. 1A and 1B, the inductive device 100 may further include an inductive structure 114 arranged over the substrate 102, in particular, over the insulative layer 106. The inductive structure 114 may be a solenoid magnetic structure.

The inductive structure 114 may include a bottom metal winding layer 114*a*, a top metal winding layer 114*b* arranged further away from the substrate 102 than the bottom metal winding layer 114*a*, and a magnetic core layer 114*c* arranged between the bottom metal winding layer 114*a* and the top metal winding layer 114*b*. Referring to FIG. 1B, the bottom metal winding layer 114*a* may be arranged within the first insulating layer 108, the magnetic core layer 114*c* may be arranged over the first insulating layer 108 and within the second insulating layer 110, and the top metal winding layer 114*b* may be arranged over the second insulating layer 110 and within the third insulating layer 112. Accordingly, as shown in FIG. 1B, the shielding layer 104 may be arranged between the substrate 102 and the bottom metal winding layer 114*a*, and the insulative layer 106 may be arranged between the shielding layer 104 and the bottom metal winding layer 114*a*.

As shown in FIGS. 1A and 1B, the inductive structure 114 may further include a plurality of connectors (e.g. connector 114*d*) arranged to electrically connect the bottom metal winding layer 114*a* and the top metal winding layer 114*b*. The connectors (e.g. connector 114*d*) may extend between the top and bottom metal winding layers 114*a*, 114*b* through the first and second insulating layers 108, 110. The bottom metal winding layer 114*a* and the top metal winding layer 114*b* may be patterned and may be arranged with the connectors (e.g. connector 114*d*), to form a conductive coil having a plurality of turns around the magnetic core layer 114*c*.

Each of the top and bottom metal winding layers 114*a*, 114*b* may include a conductive material, such as, but not limited to copper. The top and bottom metal winding layers 114*a*, 114*b* may include a same conductive material. However, the top and bottom metal winding layers 114*a*, 114*b* may alternatively include different conductive materials. The connectors (e.g. connector 114*d*) may be vias and may similarly include a conductive material, such as, but not limited to copper. The conductive material of the connectors (e.g. connector 114*d*) may be the same as or may be different from the conductive material of the top and bottom metal winding layers 114*a*, 114*b*. The magnetic core layer 114*c* may include a magnetic material. For example, the magnetic core layer 114*c* may include a soft amorphous magnetic material, such as, but not limited to cobalt-based alloys, nickel-ferrite based alloys or combinations thereof. The magnetic core layer 114*c* may include a laminated magnetic material. The shielding layer 104 may include a same material as the magnetic core layer 114*c*, but the shielding layer 104 may alternatively include a different material from the magnetic core layer 114*c*.

As shown in FIG. 1B, the inductive structure 114 may also include a bottom metal ring element 114*e* arranged around the bottom metal winding layer 114*a* and a top metal ring element 114*f* arranged around the top metal winding layer 114*b*. The inductive device 100 may further include a guard ring element 118 arranged around the magnetic core layer 114*c*. The bottom metal ring element 114*e* may be arranged under the guard ring element 118 and the guard ring element 118 may be arranged under the top metal ring element 114*f* The bottom metal ring element 114*e*, the guard ring element 118 and the top metal ring element 114*f* may have a same thickness as the bottom metal winding layer 114*a*, the magnetic core layer 114*c* and the top metal winding layer 114*b* respectively. Alternatively, the bottom metal ring element 114*e* may have a different thickness from the bottom metal winding layer 114*a*, the guard ring element 118 may have a different thickness from the magnetic core layer 114*c* and/or the top metal ring element 114*f* may have a different thickness from the top metal winding layer 114*b*. For example, the guard ring element 118 may be thicker than the magnetic core layer 114*c*.

The bottom metal ring element 114*e* may be arranged spaced apart from the bottom metal winding layer 114*a* within the first insulating layer 108; the guard ring element 118 may be arranged spaced apart from the magnetic core layer 114*c* within the second insulating layer 110; and the top metal ring element 114*f* may be arranged spaced apart from the top metal winding layer 114*b* within the third insulating layer 112. In other words, an insulating material (part of the first insulating layer 108) may be provided between the bottom metal ring element 114*e* and the bottom metal winding layer 114*a*; an insulating material (part of the second insulating layer 110) may be provided between the guard ring element 118 and the magnetic core layer 114*c*; and an insulating material (part of the third insulating layer 112) may be provided between the top metal ring element 114*f* and the top metal winding layer 114*b*.

Reducing a distance between the guard ring element 118 and the magnetic core layer 114*c* may increase the chances that the primary magnetic field lines induced by the metal winding layers 114*a*, 114*b* (in other words, the magnetic field lines contributing more to the inductance of the metal winding layers 114*a*, 114*b*) flow through the guard ring element 118, instead of through the magnetic core layer 114*c*. This may reduce the inductance of the inductive device 100. On the other hand, increasing a distance between the guard ring element 118 and the magnetic core layer 114*c* may increase the chances that the stray magnetic field lines from the magnetic core layer 114*c* interfere with adjacent metallic components (e.g. metal lines, devices or circuitry). Accordingly, a distance between the magnetic core layer 114*c* and the guard ring element 118 may be configured based on the application the inductive device 100 may be used for. For example, this distance may be dependent on the design of the inductive device 100 and/or the desired amount of shielding of adjacent metallic components from the stray magnetic field lines extending from the magnetic core layer 114*c*. This distance may be determined using simulation methods, such as, but not limited to a finite element method (FEM).

As shown in FIG. 1B, the bottom metal ring element 114*e*, the guard ring element 118 and the top metal ring element 114*f* may also be spaced apart from one another, such that an insulating material (part of the first insulating layer 108) may be provided between the bottom metal ring element 114*e* and the guard ring element 118, and an insulating material (part of the second insulating layer 110) may be provided between the top metal ring element 114*f* and the guard ring element 118.

As shown in FIG. 1A, the top metal ring element 114*f* may include gaps 114*g* and may only partially surround the top metal winding layer 114*b*. The top metal winding layer 114*b* may be electrically connected to inductor terminals 122 that may also be arranged within the third insulating layer 112. The top metal ring element 114*f* may be spaced apart and electrically isolated from the inductor terminals 122 by part of the third insulating layer 112. As shown in FIG. 1A, conductive pads 124 electrically connected to the top metal ring element 114*f* may also be provided within the third insulating layer 112. An opening may be provided in the third insulating layer 112 over each of the inductor terminals 122 and the conductive pads 124, so that these inductor terminals 122 and conductive pads 124 may be accessed by external probes during a wafer level testing process. In other words, the inductor terminals 122 and conductive pads 124 may be photo-lithographically open and not covered by insulating material. The guard ring element 118 may be a continuous ring and may completely surround the magnetic core layer 114*c*. However, depending on the application of the inductive device 100, the guard ring element 118 may include gaps and may only partially surround the magnetic core layer 114*c*. Similarly, the bottom metal ring element 114*e* may either completely or only partially surround the bottom metal winding layer 114*a*.

The guard ring element 118 may include a magnetic material. For example, the guard ring element 118 may include a soft amorphous magnetic material, such as, but not limited to cobalt-based alloys, nickel-ferrite based alloys, or combinations thereof. The guard ring element 118 may include a laminated magnetic material. Further, the guard ring element 118 may include a material that is the same as the magnetic core layer 114*c*. However, the guard ring element 118 may alternatively include a different material from the magnetic core layer 114*c*.

The bottom metal ring element 114*e* and the top metal ring element 114*f* may include metal material, such as, but not limited to copper. The bottom metal ring element 114*e* and the top metal ring element 114*f* may include a same metal material, but may alternatively include different metal materials. The bottom and top metal ring elements 114*e*, 114*f* may include a same material as the bottom and top metal winding layers 114*a*, 114*b* respectively. However, the bottom and top metal ring elements 114*e*, 114*f* may alternatively include different materials from the bottom and top metal winding layers 114*a*, 114*b* respectively.

FIGS. 2A to 2E show simplified cross-sectional views that illustrate a method for fabricating the inductive device 100 according to various non-limiting embodiments. The inductive device 100 may be fabricated using a 300 mm fabrication compatible process.

Figure 2B:
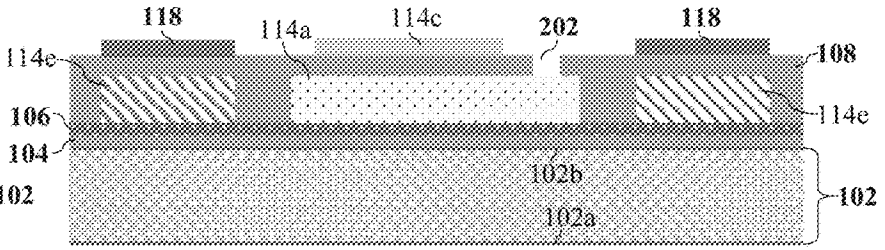
FIGS. 2A to 2E show simplified cross-sectional views that illustrate a method for fabricating the inductive device of FIGS. 1A and 1B.
Figure 2A:
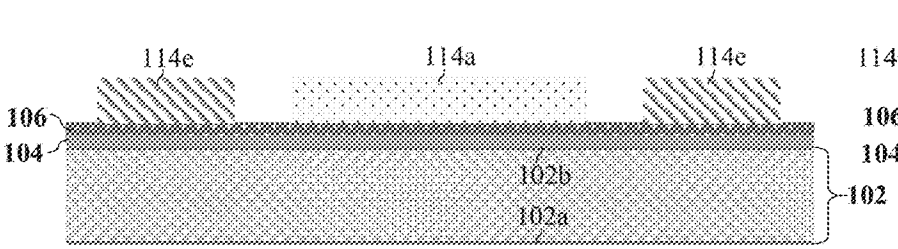

Referring to FIG. 2A, the method may include providing the substrate 102 including the first oxide layer 102*a* along the bottom surface and the second oxide layer 102*b* along the top surface. The shielding layer 104 may be formed over the substrate 102 and the insulative layer 106 may be formed over the shielding layer 104.

As shown in FIGS. 2A to 2E, the method may further include forming the inductive structure 114 and the guard ring element 118 over the substrate 102, in particular, over the insulative layer 106.

The bottom metal winding layer 114*a* and the bottom metal ring element 114*e* may be formed prior to forming the magnetic core layer 114*c* and the guard ring element 118. For example, referring to FIG. 2A, the method may first include forming the bottom metal winding layer 114*a* and the bottom metal ring element 114*e* over the insulative layer 106. The bottom metal winding layer 114*a* and the bottom metal ring element 114*e* may include a same material and may be formed simultaneously. For instance, a mask may first be formed over the substrate 102, where the mask may include openings corresponding to positions at which the bottom metal winding layer 114*a* and the bottom metal ring element 114*e* are to be formed. Metal material may then be deposited through the openings of the mask to form the bottom metal winding layer 114*a* and the bottom metal ring element 114*e*.

Referring to FIG. 2B, the method may include forming the first insulating layer 108 over the bottom metal ring element 114*e* and the bottom metal winding layer 114*a*. The guard ring element 118 and the magnetic core layer 114*c* may then be formed over the first insulating layer 108, such that the guard ring element 118 and the magnetic core layer 114*c* are spaced apart from the bottom metal ring element 114*e* and the bottom metal winding layer 114*a* respectively by the first insulating layer 108. The guard ring element 118 and the magnetic core layer 114*c* may include a same material and may be formed simultaneously. For example, the guard ring element 118 and the magnetic core layer 114*c* may be formed by forming a mask over the substrate 102, where the mask may include openings corresponding to positions over the substrate 102 at which the guard ring element 118 and the magnetic core layer 114*c* are to be formed, and depositing magnetic material through the openings of the mask. Referring to FIG. 2B, the method may also include forming openings (e.g. opening 202) in the first insulating layer 108, where the openings may be over (and may hence expose) respective parts of the bottom metal winding layer 114*a*. The openings may be formed by selectively etching the first insulating layer 108 using for example, a photoresist mask.

Figure 2D:
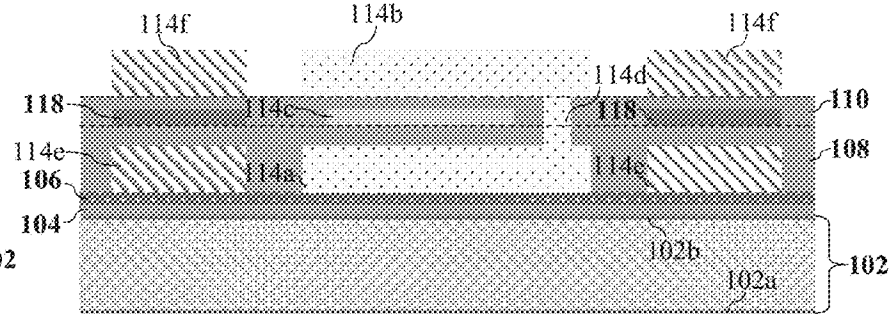
Figure 2C:
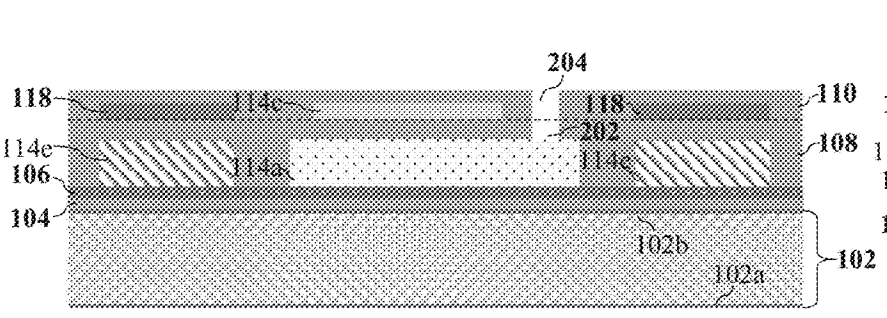

Referring to FIG. 2C, the method may further include forming the second insulating layer 110 over the guard ring element 118 and the magnetic core layer 114*c*. Further openings (e.g. opening 204) may be formed within the second insulating layer 110 over respective openings within the first insulating layer 108. Similarly, these further openings may be formed by selectively etching the second insulating layer 110 using, for example, a photoresist mask.

Referring to FIG. 2D, the method may further include forming the connectors (e.g. 114*d*) in the openings and further openings (e.g. opening 202 and further opening 204) within the first and second insulating layers 108, 110. The connectors may be formed by depositing conductive material into the openings and further openings. As shown in FIG. 2D, the method may further include forming the top metal winding layer 114*b* and the top metal ring element 114*f* over the second insulating layer 110, such that the top metal winding layer 114*b* and the top metal ring element 114*f* are spaced apart from the magnetic core layer 114*c* and the guard ring element 118 respectively by the second insulating layer 110. The top metal ring element 114*f* and the top metal winding layer 114*b* may include a same material and may be formed simultaneously. For example, the top metal ring element 114*f* and the top metal winding layer 114*b* may be formed by forming a mask over the substrate 102, where the mask may include openings corresponding to positions over the substrate 102 at which the top metal ring element 114*f* and the top metal winding layer 114*b* are to be formed, and depositing metal material through the openings of the mask.

Figure 2E:
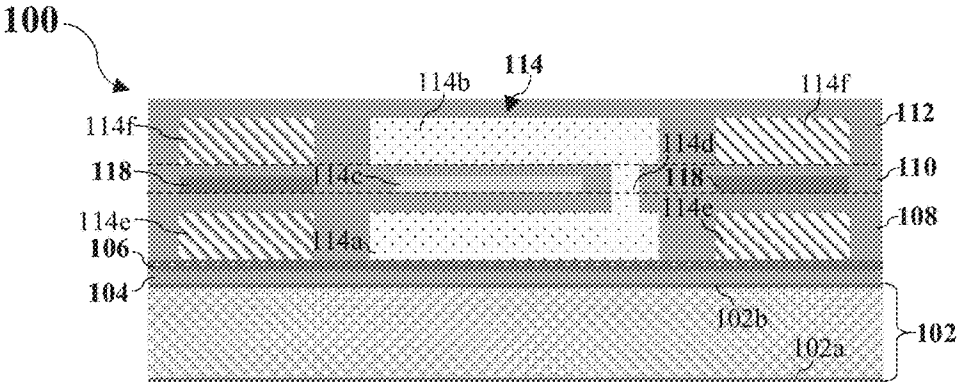

Referring to FIG. 2E, the method may include forming the third insulating layer 112 over the top metal winding layer 114*b* and the top metal ring element 114*f* for passivation. Although not shown in the figures, the method may further include forming the inductor terminals 122 and the conductive pads 124 prior to forming the third insulating layer 112. In addition, openings may be formed in the third insulating layer 112 over the inductor terminals 122 and the conductive pads 124 by for example, selectively etching this insulating layer 112 using a photoresist mask.

The above described order for the method is only intended to be illustrative, and the method is not limited to the above specifically described order unless otherwise specifically stated.

Figure 3:
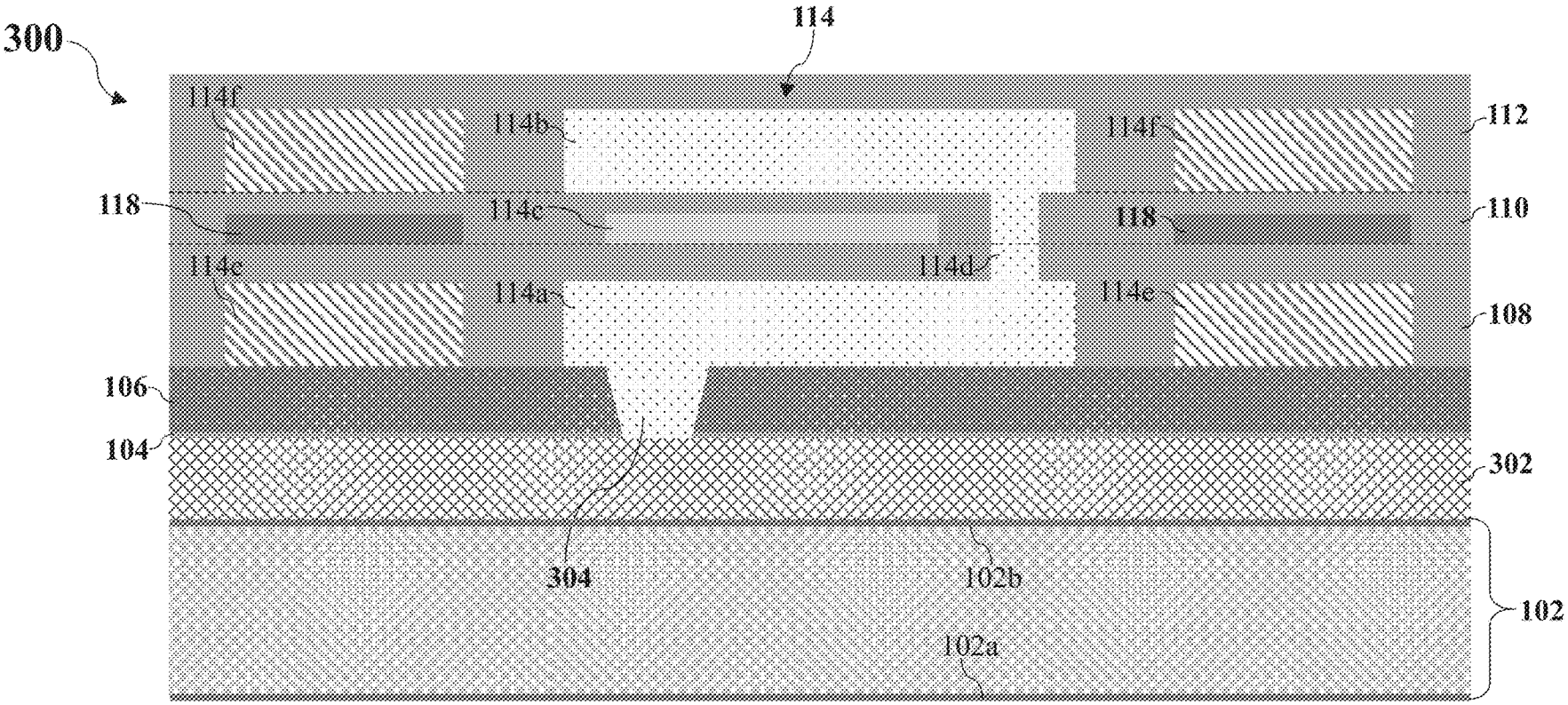
FIG. 3 shows a simplified cross-sectional view of an inductive device according to alternative non-limiting embodiments.

FIG. 3 shows a simplified cross-sectional view of an inductive device 300 according to an alternative non-limiting embodiment. The inductive device 300 is similar to the inductive device 100, and thus the common features are labelled with the same reference numerals and need not be discussed. The inductive device 300 may also be an on-chip solenoid magnetic device.

As compared to the inductive device 100, the inductive device 300 may further include an electrical circuitry 302 between the shielding layer 104 and the substrate 102 and a circuitry connector 304 arranged to electrically connect the electrical circuitry 302 and the bottom metal winding layer 114*a*. The electrical circuitry 302 may include complementary metal-oxide-semiconductor (CMOS) circuitry that may be fabricated using one or both of front-end-of-line (FEOL) technology and back-end-of-line (BEOL) technology as known to one skilled in the art. The circuitry connector 304 may connect the bottom metal winding layer 114*a* to a last metal layer of the electrical circuitry 302, and may include conductive material, such as, but not limited to, copper.

The inductive device 300 may be referred to as an integrated device, as the inductive structure 114 may be considered as integrated within the far BEOL wiring portion of a device (e.g. a CMOS device). In a non-limiting example, the inductive structure 114 of the inductive device 300 may be used for direct current to direct current (DC-DC) conversion when integrated in the far BEOL wiring portion of a bipolar-CMOS-DMOS (BCD) device. On the other hand, the inductive device 100 may be referred to as a discrete device. The inductive structures 114 of both the inductive devices 100, 300 may be configured to operate at a frequency range of 10 MHz to 50 MHz.

In the inductive device 300, a thickness of the insulative layer 106 may be substantially larger than a thickness of the shielding layer 104. The thickness of the insulative layer 106 may depend on the integration scheme used to integrate the inductive structure 114 above the electrical circuitry 302.

For instance, a thickness of the insulative layer 106 in the inductive device 300 may range from about 10 um to about 20 um (and may be about 15 um in a particular non-limiting example). A ratio of a thickness of the insulative layer 106 to a thickness of the shielding layer 104 in the inductive device 300 may range from 70:1 to 80:1. In a non-limiting example, this ratio may be approximately 75:1.

The inductive device 300 may be fabricated using a method similar to that for fabricating the inductive device 100 (e.g. as described above with reference to FIGS. 2A to 2E), except that additional processes may be performed to fabricate the electrical circuitry 302 and the circuitry connector 304. In a non-limiting example, the electrical circuitry 302 may be CMOS circuitry and may be fabricated using CMOS processes as known to those skilled in the art. The circuitry connector 304 may be fabricated by etching an opening within the insulative layer 106 and the shielding layer 104, and either filling the opening or plating the opening with a conductive material.

The top metal ring element 114*f* of the inductive device 100/300 may be used as a ground plane during a testing process of the inductive device 100/300 at the wafer level under a probe station. The bottom metal ring 114*e* may be a crack stop layer configured to prevent crack propagation during dicing of the inductive devices 100/300 (or in other words, inductive dies 100/300) from a wafer.

In the inductive device 100/300, the guard ring element 118 (surrounding the magnetic core layer 114*c*) and the shielding layer 104 (under the inductive structure 114) may provide a low magnetic resistance path for stray magnetic field lines arising from the magnetic core layer 114*c*. This can help to restrict the stray magnetic field lines within the guard ring element 118 and the shielding layer 104. Laminations within the guard ring element 118 and/or the shielding layer 104 may help to further restrict the stray magnetic field lines within themselves. Accordingly, a lower number of stray magnetic field lines may reach the adjacent metallic components and the magnetic interference to these metallic components may be reduced. In turn, the eddy currents induced by the stray magnetic field lines in the adjacent metallic components may be reduced. This can allow the inductive devices 100/300 to be placed closer to each other and closer to adjacent metallic components on a wafer. Accordingly, the density of devices on the wafer (or in other words, the number of devices per unit area on the wafer) can be increased. Therefore, electrical appliances including the inductive device 100/300 may be smaller and more reliable.

Figure 4:
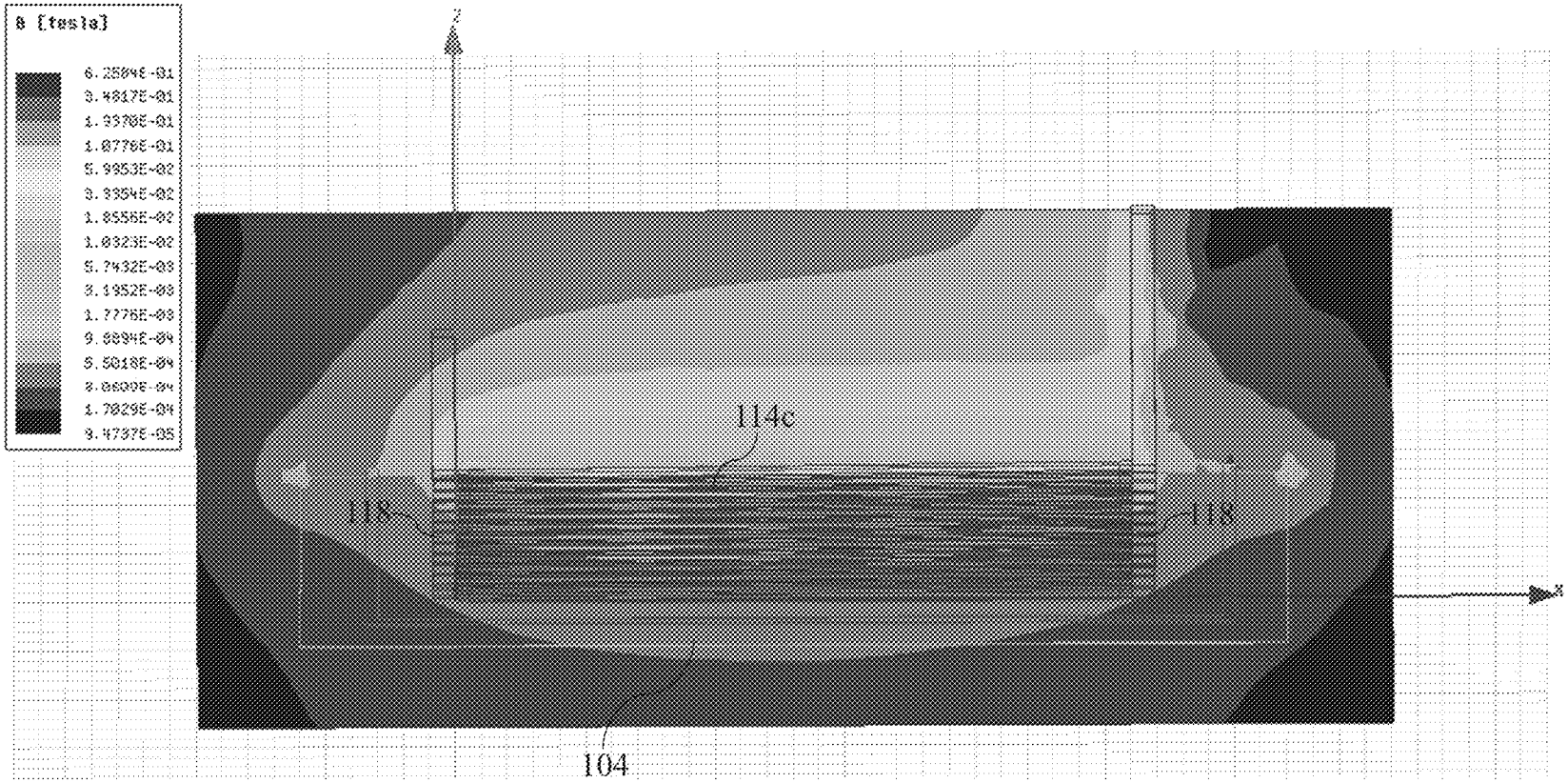
FIG. 4 shows a plot illustrating the magnetic field strength around a magnetic core layer of the inductive device of FIGS. 1A and 1B.

FIG. 4 shows a plot illustrating the strength of the magnetic field (B) around the magnetic core layer 114*c* of the inductive device 100, where the plot is obtained by modelling this magnetic field using a finite element method (FEM). In particular, FIG. 4 shows the magnetic field strength along an x-z plane through the inductive device 100, where the x axis is parallel to the substrate 102 and the z axis extends towards the top metal winding layer 114*b*. As shown in FIG. 4, the magnetic field strength below and adjacent to the magnetic core layer 114*c* along the x axis is substantially lower than the magnetic field strength within and above the magnetic core layer 114*c*. This shows that the guard ring element 118 and the shielding plane 104 can help to reduce the amount of magnetic interference to metallic components in the areas below and adjacent to the magnetic core layer 114*c* along the x-axis.

Increasing the thickness of the insulative layer 106 can further reduce the number of stray magnetic field lines extending beyond the shielding layer 104. However, increasing the thickness of the insulative layer 106 may also increase the chances that the primary magnetic field lines induced by the metal winding layers 114*a*, 114*b* pass through the insulative layer 106 and the shielding layer 104, instead of through the magnetic core layer 114*c*. Accordingly, a thickness of the insulative layer 106 may be configured such that the induced primary magnetic field lines pass through the magnetic core layer 114*c* and a sufficiently low number of stray magnetic lines extend beyond the shielding layer 104.

In the inductive device 300, the shielding layer 104 and the insulative layer 106 may cooperate to reduce the amount of magnetic interference to the electrical circuitry 302 under the inductive structure 114. In the inductive device 100, due to an absence of electrical circuitry under the inductive structure 114, the shielding layer 104 may be omitted or as mentioned above, the insulative layer 106 may have a thickness substantially the same as a thickness of the shielding layer 104. Nevertheless, a thickness of the insulative layer 106 in the inductive device 100 may also be substantially larger than a thickness of the shielding layer 104. For instance, a thickness of the insulative layer 106 may also range from about 10 um to about 20 um (and may be about 15 um in a non-limiting example), and a ratio of a thickness of the insulative layer 106 to a thickness of the shielding layer 104 in the inductive device 100 may also range from 70:1 to 80:1 (and may be approximately 75:1 in a non-limiting example).

The invention may be embodied in other specific forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of equivalency of the claims are intended to be embraced therein.

The invention claimed is:

1. An inductive device comprising:

a substrate;

an inductive structure arranged over the substrate, wherein the inductive structure comprises:

a bottom metal winding layer;

a top metal winding layer arranged further away from the substrate than the bottom metal winding layer;

a magnetic core layer arranged between the bottom metal winding layer and the top metal winding layer;

a connector arranged to electrically connect the bottom metal winding layer and the top metal winding layer; and a top metal ring element arranged around the top metal winding layer, spaced apart from the top metal winding layer; and a guard ring element arranged under the top metal ring element and around the magnetic core layer, spaced apart from the magnetic core layer; wherein the guard ring element comprises a magnetic material.

2. The inductive device according to claim 1, wherein the guard ring element comprises a laminated magnetic material.

3. The inductive device according to claim 1, wherein the guard ring element comprises a material that is the same as the magnetic core layer.

4. The inductive device according to claim 1, wherein the guard ring element completely surrounds the magnetic core layer.

5. The inductive device according to claim 1, further comprising an insulating material between the guard ring element and the magnetic core layer.

6. The inductive device according to claim 1, wherein the inductive structure further comprises a bottom metal ring element arranged under the guard ring element and around the bottom metal winding layer, spaced apart from the bottom metal winding layer, and wherein the bottom metal ring element is configured to prevent crack propagation during dicing of the inductive device from a wafer.

7. The inductive device according to claim 6, further comprising insulating material between the bottom metal ring element and the guard ring element, and insulating material between the top metal ring element and the guard ring element.

8. The inductive device according to claim 1, further comprising a shielding layer between the substrate and the bottom metal winding layer; wherein the shielding layer comprises a magnetic material.

9. The inductive device according to claim 8, wherein the shielding layer comprises a laminated magnetic material.

10. The inductive device according to claim 8, further comprising an insulative layer between the shielding layer and the bottom metal winding layer.

11. The inductive device according to claim 10, wherein a ratio of a thickness of the insulative layer to a thickness of the shielding layer ranges from 70:1 to 80:1.

12. The inductive device according to claim 8, further comprising:

an electrical circuitry between the shielding layer and the substrate; and a circuitry connector arranged to electrically connect the electrical circuitry and the bottom metal winding layer.

13. A method of forming an inductive device, the method comprising:

providing a substrate;

forming an inductive structure over the substrate, wherein the inductive structure comprises:

a bottom metal winding layer;

a top metal winding layer arranged further away from the substrate than the bottom metal winding layer;

a magnetic core layer arranged between the bottom metal winding layer and the top metal winding layer;

a connector arranged to electrically connect the bottom metal winding layer and the top metal winding layer; and a top metal ring element arranged around the top metal winding layer, spaced apart from the top metal winding layer; and forming a guard ring element of magnetic material around the magnetic core layer, wherein the guard ring element is under the top metal ring element and spaced apart from the magnetic core layer.

14. The method according to claim 13, wherein the inductive structure further comprises a bottom metal ring element around the bottom metal winding layer; wherein the bottom metal ring element is spaced apart from the bottom metal winding layer and under the guard ring element.

15. The method of claim 14, wherein the bottom metal ring element and the bottom metal winding layer are formed prior to forming the guard ring element and the magnetic core layer.

16. The method of claim 15, further comprising:

forming a first insulating layer over the bottom metal ring element and the bottom metal winding layer; and forming the guard ring element and the magnetic core layer over the first insulating layer such that the guard ring element is spaced apart from the bottom metal ring element by the first insulating layer.

17. The method of claim 16, further comprising:

forming a second insulating layer over the guard ring element and the magnetic core layer; and forming the top metal ring element and the top metal winding layer over the second insulating layer such that the top metal ring element is spaced apart from the guard ring element by the second insulating layer.

18. The method of claim 13, wherein forming the guard ring element and the magnetic core layer further comprises:

forming a mask over the substrate; wherein the mask comprises openings corresponding to positions over the substrate at which the guard ring element and the magnetic core layer are to be formed; and depositing magnetic material through the openings of the mask to form the guard ring element and the magnetic core layer.

19. The method of claim 13, further comprising forming a shielding layer of magnetic material over the substrate and forming the bottom metal winding layer over the shielding layer.

20. The method of claim 19, further comprising:

forming an insulative layer over the shielding layer; and forming the bottom metal winding layer over the insulative layer.

* * * * *